US007500466B2

(12) United States Patent
Noss et al.

(10) Patent No.: US 7,500,466 B2
(45) Date of Patent: Mar. 10, 2009

(54) VARIABLE VALVE ACTUATION AND ENGINE BRAKING

(75) Inventors: Ryan C. Noss, Vernon, CT (US); Brian L. Ruggiero, East Granby, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 11/819,911

(22) Filed: Jun. 29, 2007

(65) Prior Publication Data

US 2008/0006231 A1 Jan. 10, 2008

Related U.S. Application Data

(60) Provisional application No. 60/817,108, filed on Jun. 29, 2006, provisional application No. 60/817,204, filed on Jun. 29, 2006.

(51) Int. Cl.
*F01L 9/02* (2006.01)

(52) U.S. Cl. ..... 123/321; 123/90.12

(58) Field of Classification Search ..... 123/90.12, 123/90.13, 321, 322, 568.14
See application file for complete search history.

(56) References Cited

U.S. PATENT DOCUMENTS 5,499,606 A * 3/1996 Robnett et al. ..... 123/90.12
6,257,183 B1 * 7/2001 Vorih et al. ..... 123/90.12
6,883,492 B2 * 4/2005 Vanderpoel et al. ..... 123/322

* cited by examiner

*Primary Examiner*—Hieu T Vo
(74) *Attorney, Agent, or Firm*—David R. Yohannan, Esq.; Kelley Drye & Warren LLP

(57) ABSTRACT

Systems and methods of actuating two engine valves associated with a common engine cylinder using one or more lost motion systems and one or more control valves are disclosed. The control valves are capable of selectively trapping hydraulic fluid in the lost motion systems for auxiliary engine valve actuations and selectively releasing the hydraulic fluid to default to cam controlled valve seating of the engine valves. The systems may provide a combination of main exhaust, compression release, exhaust gas recirculation and early exhaust valve opening in preferred embodiments.

36 Claims, 10 Drawing Sheets

VARIABLE VALVE ACTUATION AND ENGINE BRAKING

CROSS REFERENCE TO RELATED APPLICATIONS

The present application is related to, and entitled to the benefit of the filing date of U.S. provisional patent application Ser. No. 60/817,108 filed Jun. 29, 2006, entitled Individual Valve Control For Variable Valve Timing or Braking, and the filing date of U.S. provisional patent application Ser. No. 60/817,204 filed Jun. 29, 2006, entitled Variable Valve Timing and Braking Through Guided Bridge, both of which are hereby incorporated by reference.

FIELD OF THE INVENTION

The present invention relates generally to systems and methods for controlling engine combustion chamber valves in an internal combustion engine. In particular, the present invention relates to systems and methods for providing lost motion engine valve actuation of one or more engine valves, preferably, but not necessarily, including lost motion engine braking.

BACKGROUND OF THE INVENTION

Engine combustion chamber valves, such as intake and exhaust valves, are typically spring biased toward a valve closed position. In many internal combustion engines, the engine valves may be opened and closed by fixed profile cams in the engine, i.e., by a valve train element. More specifically, valves may be opened or closed by one or more fixed lobes which may be an integral part of each of the cams. In some cases, the use of fixed profile cams may make it difficult to adjust the timings and/or amounts of engine valve lift. It may be desirable, however, to adjust valve opening times and/or lift for various engine operating conditions, such as positive power operation versus engine braking operation, or for different engine speeds during positive power and engine braking operation.

A method of adjusting valve timing and lift given a fixed cam profile, is to incorporate a "lost motion" device in the valve train linkage between the engine valve and the cam. Lost motion is the term applied to a class of technical solutions for modifying the valve motion dictated by a cam profile with a variable length mechanical, hydraulic, or other linkage means. The lost motion system may comprise a variable length device included in the valve train linkage between the cam and the engine valve. The lobe(s) on the cam may provide the "maximum" (longest dwell and greatest lift) motion needed for a range of engine operating conditions. When expanded fully, the variable length device (or lost motion system) may transmit all of the cam motion to the valve, and when contracted fully, transmit none or a reduced amount of cam motion to the valve. By selectively decreasing the length of the lost motion system, part or all of the motion imparted by the cam to the valve can be effectively subtracted or "lost."

Hydraulic-based lost motion systems may provide a variable length device through use of a hydraulically extendable and retractable piston assembly. The length of the device is shortened when the piston is retracted into its hydraulic chamber, and the length of the device is increased when the piston is extended out of the hydraulic chamber. Alternatively, a hydraulic-based lost motion system may utilize a hydraulic circuit including a master piston and a slave piston which is selectively charged with hydraulic fluid to actuate an engine valve. The master and slave circuit may be depleted of hydraulic fluid when it is desired to "lose" the valve actuation motion input to the master piston, and the circuit may be charged with hydraulic fluid when it is desired to transfer the motion from the master piston to the slave piston and the engine valve. One or more hydraulic fluid control valves may be used to control the flow of hydraulic fluid into and out of the hydraulic chamber or hydraulic circuit.

One type of lost motion system, known as a Variable Valve Actuation (VVA) system, may provide multiple levels of lost motion. Hydraulic VVA systems may employ a high-speed control valve, referred to herein as a trigger valve, to rapidly change the amount of hydraulic fluid in the hydraulic chamber or circuit between the master and slave lost motion pistons. The trigger valve may be capable of rapidly draining hydraulic fluid from the chamber or circuit, thereby allowing the lost motion system to selectively lose a portion of an engine valve event to provide variable levels of valve actuation.

In the lost motion system of U.S. Pat. No. 5,680,841, an engine cam shaft may actuate a master piston which displaces fluid from its hydraulic chamber into a hydraulic chamber of a slave piston. The slave piston in turn acts on the engine valve to open it. The lost motion system may include a solenoid trigger valve in communication with the hydraulic circuit that includes the chambers of the master and slave pistons. The solenoid valve may be maintained in a closed position in order to retain hydraulic fluid in the circuit when the master piston is acted on by certain of the cam lobes. As long as the solenoid valve remains closed, the slave piston and the engine valve respond directly to the hydraulic fluid displaced by the motion of the master piston, which reciprocates in response to the cam lobe acting on it. When the solenoid is opened, the circuit may drain, and part or all of the hydraulic pressure generated by the master piston may be absorbed by the circuit rather than be applied to displace the slave piston and the engine valve.

Lost motion systems that utilize a master and slave circuit normally require that the master piston and the slave piston be provided in a common housing that can withstand the required high hydraulic pressures. Further, it may be desirable to place the master and slave pistons in close proximity to one another to avoid hydraulic compliance issues. Still further, it may be necessary to position the slave piston above the engine valve or valves that it actuates and to place the master piston such that it may receive valve actuation motion from a valve train element such as a rocker arm, cam, push tube, or the like. The foregoing requirements may present challenges to lost motion system designers due to the need to place the lost motion system into an already existing valve train in an engine compartment of limited size. Therefore, there is a need for a lost motion system which has a low profile relative to an existing valve train and which requires less engine compartment space.

Previous lost motion systems have typically not utilized high speed mechanisms to rapidly vary the length of the lost motion system, although the aforementioned '841 patent does contemplate the use of a high speed trigger valve. High speed lost motion systems in particular, are needed to provide Variable Valve Actuation (VVA). True variable valve actuation is contemplated as being sufficiently fast as to allow the lost motion system to assume more than one length within the duration of a single cam lobe motion, or at least during one cycle of the engine. By using a high speed mechanism to vary the length of the lost motion system, sufficiently precise control may be attained over valve actuation to enable more optimal valve actuation over a range of engine operating conditions. While many devices have been suggested for realizing various degrees of flexibility in valve timing and lift, lost motion hydraulic variable valve actuation is becoming recognized for superior potential in achieving the best mix of flexibility, low power consumption, and reliability.

Engine benefits from lost motion VVA systems can be achieved by creating complex cam profiles with extra lobes or bumps to provide auxiliary valve lifts in addition to the conventional main intake and exhaust events. Many unique modes of engine valve actuation may be produced by a VVA system that includes multi-lobed cams. The lost motion VVA system may be used to selectively cancel or activate any or all combinations of valve lifts possible from the assortment of lobes provided on the intake and exhaust cams. As a result, significant improvements may be made to both positive power and engine braking operation of the engine.

One particular engine valve actuation enabled by lost motion systems that is frequently desired by diesel engine manufacturers and operators is compression release engine braking operation. During engine braking, the exhaust valves may be selectively opened to convert, at least temporarily, an internal combustion engine into an air compressor. This air compressor effect may be accomplished by partially opening one or more exhaust valves near piston top dead center position for compression-release type braking, or by maintaining one or more exhaust valves in a partially open position for much or all of the piston motion for bleeder type braking. In doing so, the engine develops retarding horsepower to help slow the vehicle down. This can provide the operator increased control over the vehicle and substantially reduce wear on the service brakes of the vehicle. A properly designed and adjusted engine brake can develop retarding horsepower that is a substantial portion of the operating horsepower developed by the engine in positive power.

Another engine valve actuation that may be provided using a lost motion system is Exhaust Gas Recirculation (EGR). The braking power of an engine brake may be increased by selectively opening the exhaust and/or intake valves to carry out exhaust gas recirculation in combination with engine braking. Exhaust gas recirculation denotes the process of channeling exhaust gas back into the engine cylinder after it is exhausted out of the cylinder. The recirculation may take place through the intake valve or the exhaust valve. When the exhaust valve is used, for example, the exhaust valve may be opened briefly near bottom dead center on the intake stroke of the piston. Opening of the exhaust valve at this time may permit higher pressure exhaust gas from the exhaust manifold to circulate back into the cylinder. The recirculation of exhaust gas may increase the total gas mass in the cylinder at the time of the subsequent engine braking event, thereby increasing the braking effect realized.

Still another engine valve actuation that may be provided using a lost motion system is Early Exhaust Valve Opening (EEVO). Variation of the opening time of an exhaust valve during positive power can improve exhaust gas temperature control needed for emissions after treatment and/or provide turbocharger stimulation for improved transient torque. Therefore there is a need for a valve actuation system that is capable of providing variable levels of EEVO in response to engine operation conditions.

Used in conjunction with a properly designed lost motion system, trigger valves may provide true variable valve actuation responsive to a particular engine operation mode, engine speed, engine load, and/or other engine parameter that changes during operation. Trigger valves, however, require a sizable solenoid to operate at the required speeds for variable valve actuation. The combined size of the "valve" portion of the trigger valve and the solenoid may make it impractical to provide a dedicated trigger valve for each engine valve. The ability to provide variable valve actuation for each engine valve, however, would be advantageous. In particular, the ability to provide both compression release engine braking, exhaust gas recirculation, and/or EEVO using a given pair of engine exhaust valves that communicate with a common engine cylinder would be advantageous. Accordingly, there is a need for a lost motion system, and in particular a variable valve actuation lost motion system, that utilizes a single control valve, preferably a trigger valve, for control of more than one engine valve to provide compression release engine braking, exhaust gas recirculation, EEVO, and/or potentially other engine valve actuations.

Space and weight considerations are also of considerable concern to engine manufacturers. Accordingly it is desirable to reduce the size and weight of the engine subsystems responsible for valve actuation. Some embodiments of the present invention are directed towards meeting these needs by providing a compact master-slave piston and trigger valve combination for the lost motion VVA system. Applicants have discovered that some unexpected advantages may also be realized by reducing the size of the lost motion VVA system. As a result of reduction of the overall size of the system, the attendant hydraulic passages therein may be reduced in volume, thus improving hydraulic compliance.

Providing hydraulic fluid for initial operation of hydraulic-based VVA systems during engine start up also may be a concern of VVA designers and manufacturers. As some VVA systems may require hydraulic fluid immediately in order to provide basic engine valve actuations such as main intake and main exhaust events, it may be desirable to provide a VVA system which does not require any hydraulic fluid for main intake and main exhaust engine valve actuation.

Typically, engine valves are required to open and close very quickly, and therefore the valve return springs are generally relatively stiff. If left unchecked after a valve opening event, the valve return spring could cause the valve to impact its seat with sufficient force to cause damage to the valve and/or its seat. In valve actuation systems that use a valve lifter to follow a cam profile, the cam profile provides built-in valve closing velocity control. The cam profile may be formed so that the actuation lobe merges gently with cam base circle, which acts to decelerate the engine valve as it approaches its seat.

In some hydraulic lost motion systems, and in particular VVA hydraulic lost motion systems, rapid draining of fluid from the hydraulic circuit may prevent the valve from experiencing the valve seating provided by a cam profile. In some VVA systems, for example, an engine valve may be closed at an earlier time than that provided by the cam profile by rapidly releasing hydraulic fluid from the lost motion system. When fluid is released from the lost motion system, the valve return spring may cause the engine valve to "free fall" and impact the valve seat at an unacceptably high velocity. The engine valve may impact the valve seat with such force that it eventually erodes the valve or valve seat, or even cracks or breaks the valve. In such instances, engine valve seating velocity has been limited by controlling the release of hydraulic fluid from the lost motion system instead of by a fixed cam profile. Such devices have been referred to as "valve seating" devices or "valve catches."

Valve seating devices may include hydraulic elements, and thus may need to be supported in a housing and require a supply of hydraulic fluid, yet at the same time fit within the packaging limits of a particular engine. The need to employ one or more valve seating devices thus adds complexity, cost, weight, and consumes limited engine compartment space.

Further, the need to employ valve seating devices increases risk of engine failure or damage should the device ever fail or be denied of hydraulic fluid. Accordingly, it may be advantageous to provide a lost motion system, and particularly a VVA system, that does not require a valve seating device to gently seat an engine valve at the conclusion of an engine valve event.

Various embodiments of the present invention may meet one or more of the aforementioned needs and provide other benefits as well. Additional advantages of the invention are set forth, in part, in the description that follows and, in part, will be apparent to one of ordinary skill in the art from the description and/or from the practice of the invention.

SUMMARY OF THE INVENTION

Applicant has developed an innovative valve actuation system for actuating at least two engine valves in an internal combustion engine, comprising: a first master piston and slave piston lost motion system adapted to actuate a first engine valve in a first engine cylinder; a second master piston and slave piston lost motion system adapted to actuate a second engine valve in the first engine cylinder; and a control valve in hydraulic communication with the first and second master piston and slave piston lost motion systems.

Applicant has further developed an innovative system for actuating at least two engine valves in an internal combustion engine, comprising: a housing having a hydraulic fluid supply passage; a first hydraulic lost motion system disposed in said housing and adapted to contact a first engine valve in an engine cylinder; a second hydraulic lost motion system disposed in said housing and adapted to contact a second engine valve in the engine cylinder; and a hydraulic control valve disposed in said housing between the (i) hydraulic fluid supply passage and (ii) the first and second hydraulic lost motion systems.

Applicant has still further developed an innovative method of actuating two engine valves associated with a common engine cylinder using first and second lost motion systems and a common control valve, comprising the steps of: providing hydraulic fluid to the first lost motion system during a first engine operating mode; selectively maintaining hydraulic fluid in the first lost motion system under the control of the common control valve during the first engine operating mode; providing hydraulic fluid to the second lost motion system during a second engine operating mode; and selectively maintaining hydraulic fluid in the second lost motion system under the control of the common control valve during the second engine operating mode.

Applicant has further developed an innovative system for actuating at least two engine valves in an internal combustion engine, said system comprising: a housing having a central opening and hydraulic passages extending to a master piston bore and a slave piston bore, respectively; a valve bridge adapted to extend between engine valves, said valve bridge having a central guide member extending through the housing central opening and a hydraulic passage extending through the central guide member; a sliding pin extending through the valve bridge and adapted to contact one of the engine valves; a master piston disposed in the master piston bore; a slave piston disposed in the slave piston bore and contacting the sliding pin; and a control valve communicating with the hydraulic passage extending to the slave piston bore.

Applicant has further developed an innovative system for actuating at least two engine valves in an internal combustion engine, said system comprising: a housing having a central opening and hydraulic passages extending from said central opening to a first master piston bore and a slave piston bore, respectively; a valve bridge adapted to extend between engine valves, said valve bridge having a central guide member extending through the housing central opening, a second master piston bore provided an upper end of the central guide member, and a hydraulic passage extending through the central guide member and communicating with the second master piston bore; a sliding pin extending through the valve bridge and adapted to contact one of the engine valves; a first master piston disposed in the first master piston bore; a second master piston disposed in the second master piston bore; a slave piston disposed in the slave piston bore and contacting the sliding pin; and a control valve communicating with the hydraulic passage extending to the slave piston bore.

It is to be understood that both the foregoing general description and the following detailed description are exemplary and explanatory only, and are not restrictive of the invention as claimed. The accompanying drawings, which are incorporated herein by reference, and which constitute a part of specification, illustrate certain embodiments of the invention and, together with the detailed description, serve to explain the principles of the present invention.

BRIEF DESCRIPTION OF THE DRAWINGS

In order to assist in the understanding of the invention, reference will now be made to the appended drawings, in which like reference characters refer to like elements. The drawings are exemplary only, and should not be construed as limiting the invention.

DETAILED DESCRIPTION OF PREFERRED EMBODIMENTS OF THE INVENTION

Figure 1:
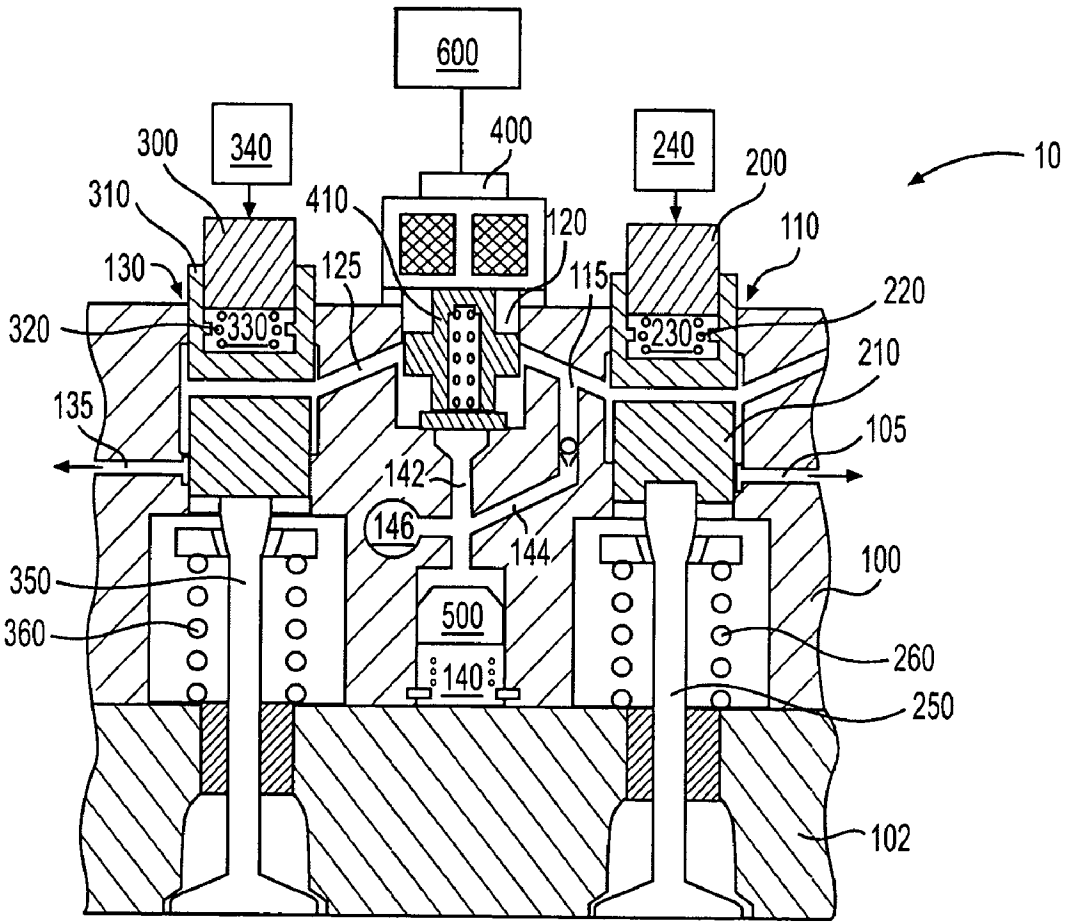
FIG. 1 is a schematic cross-sectional diagram of an engine valve actuation system in accordance with a first embodiment of the present invention.

As embodied herein, the present invention includes both systems and methods of controlling the actuation of engine valves. Reference will now be made in detail to a first embodiment of the present invention, an example of which is illustrated in the accompanying drawings. A first embodiment of the present invention is shown in FIG. 1 as valve actuation system 10.

The valve actuation system 10 may include a housing 100 connected to an engine cylinder head 102. First and second engine exhaust valves 250 and 350 may be disposed in the cylinder head 102 to provide selective communication between an engine cylinder and an engine manifold (not shown). It is appreciated that the invention is not limited to use with exhaust valves, but may also be used with intake and/or auxiliary valves. The first and second engine valves 250 and 350 may be biased by valve springs 260 and 360, respectively, into closed positions.

The housing 100 may include a first tappet bore 110 and a second tappet bore 130. A first tappet comprised of a first master piston 200 and a first slave piston 210 may be slidably disposed in the first tappet bore 110, and a second tappet comprised of a second master piston 300 and a second slave piston 310 may be slidably disposed in the second tappet bore 130. The first and second slave pistons 210 and 310 may be capable of sliding within their respective tappet bores 110 and 130 while maintaining a hydraulic seal with each bore. The first and second slave pistons 210 and 310 may further include first and second slave piston bores 230 and 330, respectively, and one or more internal passages extending from the slave piston side walls to the slave piston bores.

The first and second master pistons 200 and 300 may be slidably disposed within the first and second slave piston bores 230 and 330. The master pistons 200 and 300 may slide within the slave pistons 210 and 310 while maintaining a hydraulic seal therewith. It is appreciated that the connection of the slave pistons with the master pistons could be modified so that the slave pistons are received in bores provided in larger diameter master pistons without departing from the intended scope of the invention. With continued reference to FIG. 1, optional first and second springs 220 and 320 may assist in biasing the first and second master pistons 200 and 300 into contact with the first and second valve train elements 240 and 340, respectively.

Figure 2:
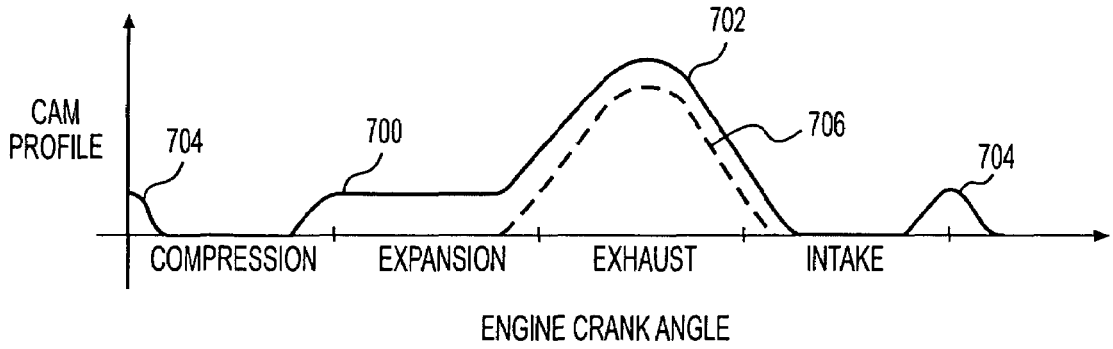
FIG. 2 is a graph of a first cam profile that may act on the engine valve actuation system illustrated in FIG. 1 to provide compression release engine braking and exhaust gas recirculation.
Figure 3:
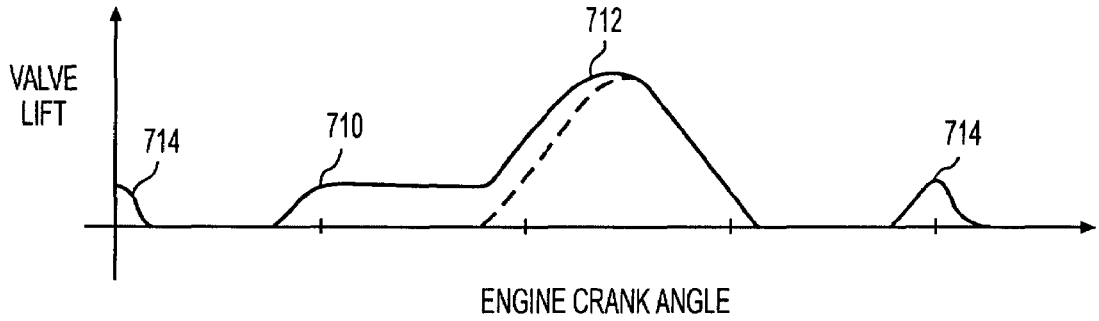
FIG. 3 is a graph of valve lift versus engine crank angle illustrating the compression release engine braking and exhaust gas recirculation valve actuations that may be provided by the cam profile illustrated in FIG. 2 when used with the engine valve actuation system illustrated in FIG. 1.
Figure 4:
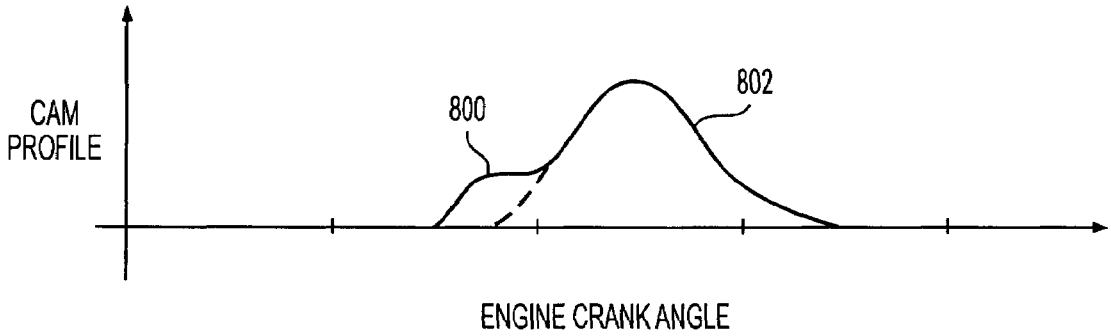
FIG. 4 is a graph of a second cam profile that may act on the engine valve actuation system illustrated in FIG. 1 to provide early exhaust valve opening.
Figure 5:
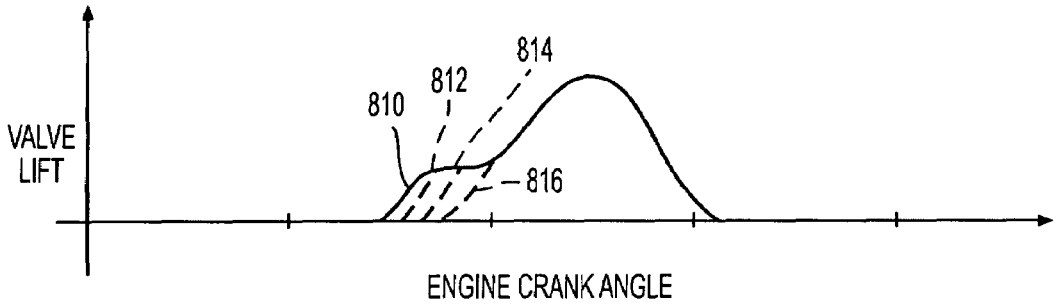
FIG. 5 is a graph of valve lift versus engine crank angle illustrating the early exhaust valve opening valve actuation that may be provided by the cam profile illustrated in FIG. 4 when used with the engine valve actuation system illustrated in FIG. 1.
Figure 6:
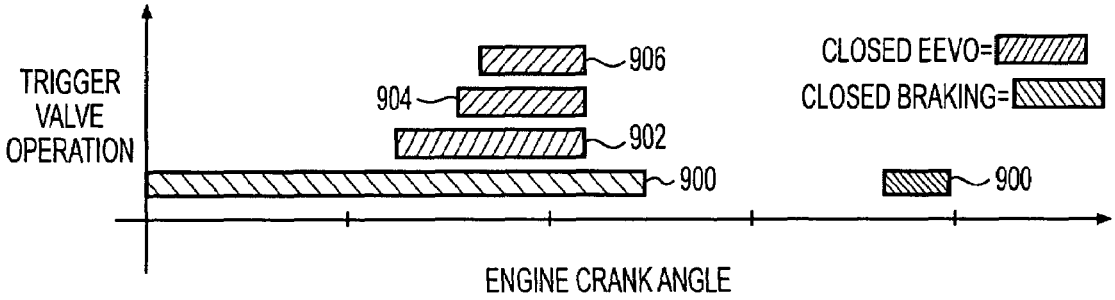
FIG. 6 is a bar graph of trigger valve operation versus engine crank angle that may be used to provide the compression release engine braking, brake gas recirculation, and EEVO engine valve actuations illustrated in FIGS. 3 and 5.

The valve train elements 240 and 340 may include any one or combination of cam(s), push tube(s), rocker arm(s) or other valve train element(s) that provide an input motion to the master pistons 200 and 300. Examples of means for imparting motion, that may be used in conjunction with the present invention are described in U.S. Patent Publication No. 2006-0005796, which is assigned to the same assignee as the present application and which is incorporated herein by reference. In a preferred embodiment, the first valve train element 240 includes a cam with a profile as shown in FIG. 2, and the second valve train element 340 includes a cam with a profile as shown in FIG. 4.

A control valve bore 120 may be located between the first and second tappet bores 110 and 130. A control valve comprising a solenoid 400 and a valve body 410 may be disposed in the control valve bore 120. An electronic controller 600, such as an ECM or the like, may be connected to the solenoid 400. The controller 600 may comprise any electronic or mechanical device for communicating with the hydraulic valve actuation system 10. The controller 600 may include a microprocessor, linked to an appropriate vehicle component (s) including, without limitation, an engine speed sensing means, a clutch position sensing means, a fuel position sensing means, and/or a vehicle speed sensing means. Under prescribed conditions, the controller 600 may produce a signals and transmit the signals to the solenoid 400, which will, in turn, open and close the valve body 410 as needed.

A first passage 115 may extend from the control valve bore 120 to the first tappet bore 110, and a second passage 125 may extend from the control valve bore 120 to the second tappet bore 130. A third passage 142 may extend from the control valve bore 120 to a hydraulic fluid supply passage 146 and an accumulator bore 140. When the valve body 410 is closed, as shown in FIG. 1, communication between the first passage 115, the second passage 125 and the third passage 142 may be blocked. When the valve body 410 is open, it slides upward in the control valve bore 120, resulting in hydraulic communication between the first, second and third passages 115, 125 and 142.

An accumulator piston 500 may be spring biased into the accumulator bore 140. Optional passage(s) 144 may extend from the hydraulic fluid supply passage 146 to the first passage 115 and/or to the second passage 125. The optional passage(s) 144 may provide quicker initial fill and refill of the first slave piston bore 230. While not shown, it is appreciated that a similar optional passage could be provided between the hydraulic fluid supply passage 146 and the second passage 125. Check valves that permit one-way flow of hydraulic fluid to the first and second passages 115 and 125 may also be provided in the optional passage(s) 144.

A first clipping passage 105 may extend from the first tappet bore 110 to the ambient surrounding the housing 100, and a second clipping passage 135 may extend from the second tappet bore 130 to the ambient. Alternatively, the first and second clipping passages may return hydraulic fluid to the fluid supply passage 146 or the accumulator 500. The position of the first and second clipping passages 105 and 135 may be selected to vent hydraulic fluid from the first and second slave pistons 210 and 310 when the internal passage (s) in the slave pistons register with the clipping passages. More specifically, the location of the first and second clipping passages 105 and 135 may be selected such that the downward travel of the first and second slave pistons 210 and 310 is not clipped until the slave piston travel exceeds that provided by the compression release cam profile 700 and the EEVO cam profile 800 shown in FIGS. 2 and 4, respectively. Preferably, clipping may not occur until the first and second engine valves 250 and 350 approaches the maximum lift desired for main exhaust valve actuation.

The hydraulic valve actuation system 10 may selectively transfer all of the motion input by the valve train element(s) 240 and 340 by selectively providing hydraulic fluid to the slave piston bores 230 and 330. When hydraulic fluid is provided to the slave piston bores 230 and 330, and the valve body 410 is maintained in a closed position, the master pistons 200 and 300 may be hydraulically locked in an extended position between the valve train elements 240 and 340 and the slave pistons 210 and 310. During this time, all of the linear motion input from the first and second valve train elements 240 and 340 to the first and second master pistons 200 and 300 may be transferred to the first and second slave pistons 210 and 310 and in turn, to the first and second engine valves 250 and 350. The motion transferred to the slave pistons 210 and 310 may be selectively "lost" by selectively opening the valve body 410. For example, with respect to the first tappet, when the valve body 410 is opened, the pressurized hydraulic fluid in the first slave piston bore 230 may escape through the first passage 115 and the third passage 142 to the accumulator 500 and the ambient (the accumulator may overflow to the ambient). As a result, the first master piston 200 may slide into the first slave piston 210. The amount of valve actuation motion that is lost may be equivalent to the distance that the first master piston 200 slides into the first slave piston 210. This distance may be controlled through selective opening and closing of the valve body 410. Further, the timing at which the valve actuation motion is lost may also be controlled through selective opening and closing of the valve body 410. When the first master piston 200 is pressed into the first slave piston 210 as far as it can go, valve actuation motion that exceeds the travel of the first master piston into the slave piston will be mechanically transferred from the first master piston to the first slave piston and first engine valve 250.

The motion transferred to the first and second engine valves 250 and 350, and the loss of such motion, may be used to produce various engine valve events, such as, but not limited to, main intake, main exhaust, compression release braking, bleeder braking, external and/or internal exhaust gas recirculation, early exhaust valve opening, early intake closing, centered lift, late exhaust and intake valve closing, etc.

Description of the use of the system 10 illustrated in FIG. 1 to provide EGR, compression release and EEVO valve actuations will now be provided with reference to FIGS. 1-6. With reference to FIGS. 1 and 2, a first cam which comprises part or all of the first valve train element 240 may include a compression release lobe 700, a main exhaust lobe 702 and a EGR lobe 704. The profile of a conventional cam having only a main exhaust lobe 706 is illustrated for comparison purposes. When engine braking is desired, the valve body 410 may be closed during the period 900 illustrated in FIG. 6. When the first valve train element cam 240 is at base circle (primarily during the intake cycle), the valve body 410 may be open. During this time, hydraulic fluid that may fill the first slave piston bore 230 through the first passage 115. Optional passage 144 may keep the first slave piston bore 230 in a filled state in an alternative embodiment. Before encountering the compression release lobe 700 or the EGR lobe 704, the valve body 410 may be closed so that the first master piston 200 is hydraulically locked into an extended position. Thereafter, the motion from the EGR lobe 704 and the compression release lobe 700 shown in FIG. 2 may be transferred through the first master and slave pistons 200 and 210 to the first engine valve 250 to provide the EGR valve actuation 714 and the compression release valve actuation 710 shown in FIG. 3.

When the first master and slave pistons 200 and 210 encounter the main exhaust lobe 702 shown in FIG. 2, the first slave piston may be pushed sufficiently far into the first tappet bore 110 that the internal passages in the first slave piston register with the first clipping passage 105. Registration of the internal passages in the first slave piston 210 with the first clipping passage 105 enables the hydraulic fluid in the first slave piston bore 230 to vent to the ambient (or the accumulator), causing the first master piston 200 to collapse within the first slave piston 210 and thereby clip the main exhaust valve actuation 712. As a result, the lift experienced by the first engine valve 250 for a main exhaust valve actuation 712 may be the same during engine braking as it is during positive power operation. Furthermore, because the first master piston 200 is in mechanical contact with the first slave piston 210 during the later portion of the main exhaust valve actuation 712, it may be the mechanical influence of the first valve train element cam 240 that seats the first engine valve, eliminating the need for a valve seating device. The accumulator 500 may assist in refilling the first slave piston bore 230 for subsequent EGR and/or compression release valve actuations.

When engine braking and/or EGR is no longer desired, the valve body 410 may be maintained in an open position during the time the first master piston 200 encounters the initial portion of the compression release lobe 700 and/or during the time the first master piston encounters the EGR lobe 704. When the valve body 410 is maintained open at these times, the first master piston 200 may be pushed into the first slave piston 210 for the compression release and EGR valve actuations so that these actuations are not transferred to the first engine valve 250. As a result, the compression release and/or EGR valve actuations may be "lost" or absorbed by the first master piston 200.

The same valve body 410 may be used to provide EEVO for the second engine valve 350. With reference to FIGS. 1 and 4, a second cam which comprises part or all of the second valve train element 340 may include an EEVO lobe 800 and a main exhaust lobe 802. When EEVO is desired, the valve body 410 may be closed during any of the periods 902, 904 or 906 illustrated in FIG. 6. When the second cam 340 is at base circle, the valve body 410 may be open. During this time, hydraulic fluid may fill the second slave piston bore 330 through the second passage 125 and/or an optional passage (not shown). Before encountering or during the initial portion of the EEVO lobe 800, the valve body 410 may be closed so that the second master piston 300 is hydraulically locked into an extended position. Thereafter, the motion from the EEVO lobe 800 shown in FIG. 4 may be transferred through the second master and slave pistons 300 and 310 to the second engine valve 350 to provide one of the EEVO valve actuations 810, 812 or 814 shown in FIG. 5. The particular EEVO valve actuation provided may correspond to the time that the valve body 410 is closed. For example, closing the valve body 410 for the period 902 (FIG. 6) may result in EEVO valve actuation 810 (FIG. 5), closing the valve body for the period 904 may result in EEVO valve actuation 812, and closing the valve body for the period 906 may result in EEVO valve actuation 814. By selectively varying the closing time for the valve body 410, the amount of EEVO provided may be varied. Maintaining the valve body 410 in a open position may result in no EEVO valve actuation, which is the equivalent of the conventional main exhaust valve actuation 816 shown in FIG. 5. Clipping the travel of the second slave piston 310 may be carried out in like fashion to that for the first slave piston 210, described above.

Figure 7:
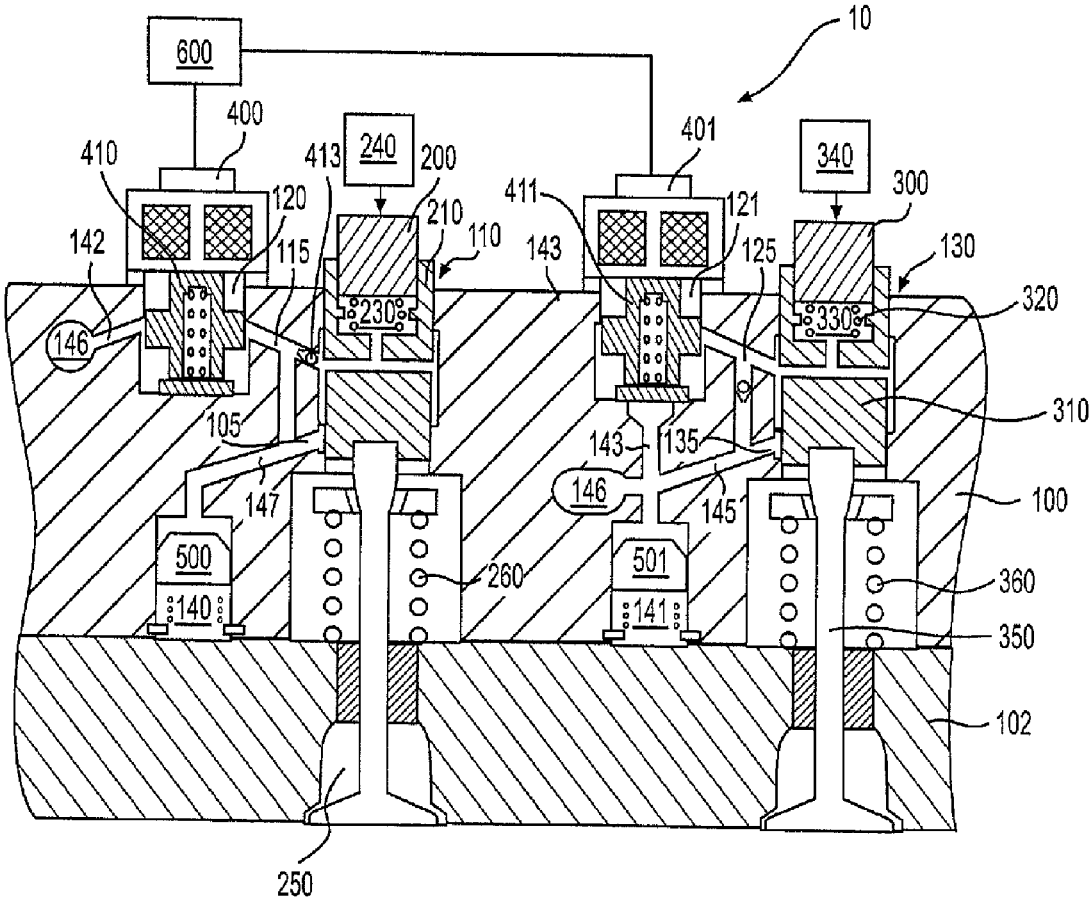
FIG. 7 is a schematic cross-sectional diagram of an engine valve actuation system in accordance with a second embodiment of the present invention.

A second embodiment of the present invention is illustrated in FIG. 7, in which like elements are identified with like reference characters. In the embodiment shown in FIG. 7, the control valve body 410 may be dedicated to controlling hydraulic fluid in the first slave piston 210 only, and more specifically for engine braking. The solenoid 400 and valve body 410 may be low speed and low pressure devices that are protected from exposure to high pressure by a check valve 413. Hydraulic fluid may be provided from the hydraulic fluid supply passage 146 to the control valve body 410 via the third passage 142. The control valve body 410 may selectively supply hydraulic fluid to the first slave piston 210 via the first passage 115, which may include an optional check valve therein. A fourth passage 147 may extend between the first passage 115, the accumulator 500, and the first clipping passage 105. The fourth passage 147 may permit the accumulator 500 to assist with refill of the first slave piston bore 230.

A second control valve bore 121 may be located in the housing 100. A second control valve comprising a second solenoid 401 and a second valve body 411 may be disposed in the second control valve bore 121. In a preferred embodiment, the second solenoid 401 and a second valve body 411 may comprise a high speed trigger valve adapted to be exposed to high hydraulic pressures and to quickly release hydraulic fluid to the second accumulator 501. The electronic controller 600 may be connected to the second solenoid 401.

The second control valve body 411 may be dedicated to controlling hydraulic fluid in the second slave piston 310 only. Hydraulic fluid may be provided from the hydraulic fluid supply passage 146 to the second control valve body 411 via a fifth passage 143. The second control valve body 411 may selectively supply hydraulic fluid to the second slave piston 310 via the second passage 125, which may include an optional check valve therein. A sixth passage 145 may extend between the second passage 125, a second accumulator 501, and the second clipping passage 135. The second accumulator 501 may be slidably disposed in a second accumulator bore 141. The first and second valve bodies 410 and 411 may be selectively controlled to provide the main exhaust, compression release engine braking, exhaust gas recirculation and early exhaust valve opening valve actuations described above in connection with FIGS. 2-4.

Figure 8:
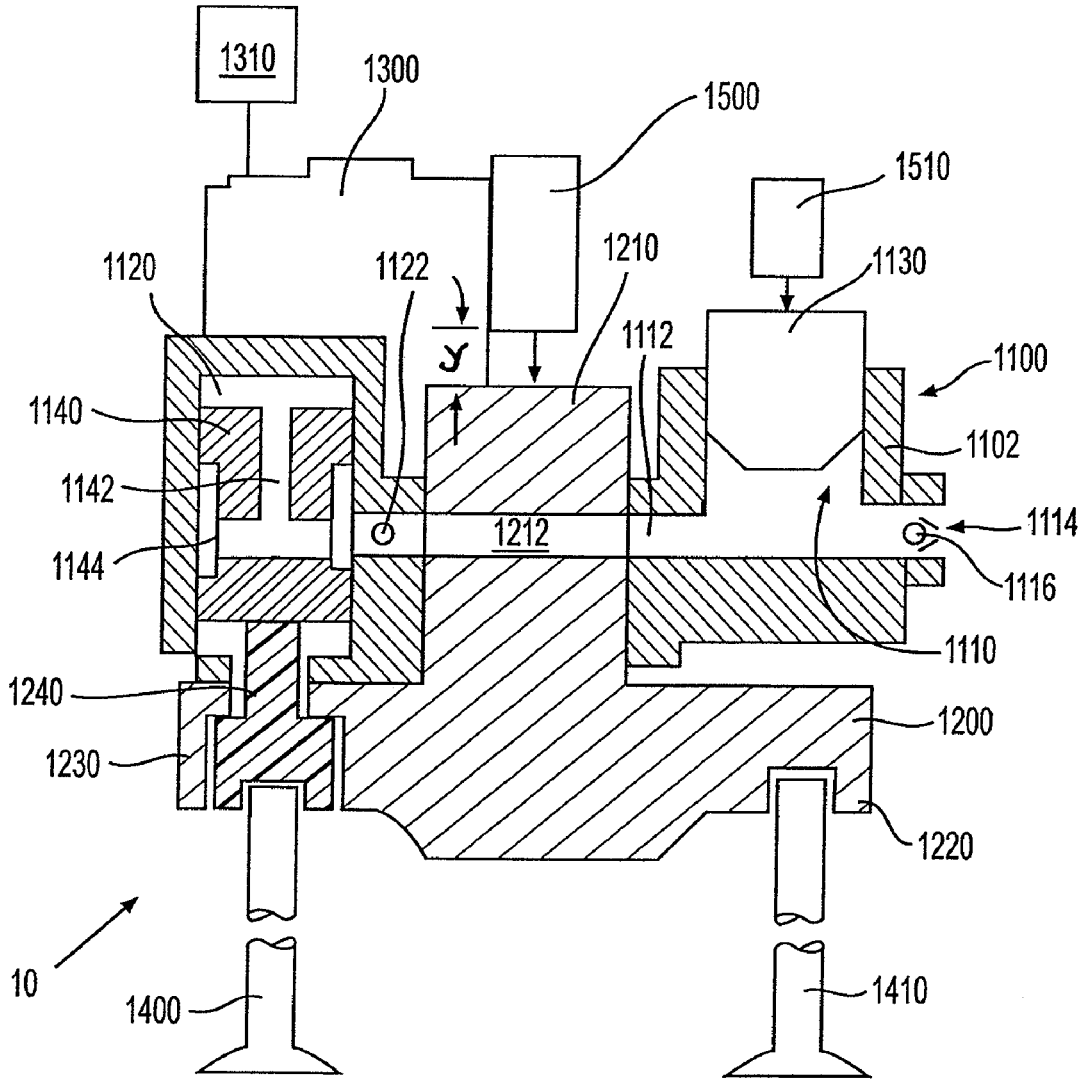
FIG. 8 is a cross-sectional schematic diagram of an engine valve actuation system in accordance with an alternative embodiment of the present invention.

With reference to FIG. 8, in another embodiment of the valve actuation system 10 of the present invention, the system may include a lost motion system 1100, a valve bridge 1200, a hydraulic fluid control valve 1300, first and second engine valves 1400 and 1410, and first and second valve train elements 1500 and 1510.

The lost motion system 1100 may include a housing 1102 having a master piston bore 1110 and a slave piston bore 1120. A central opening may be located in the housing 1102 between the master piston bore 1110 and the slave piston bore 1120. The central opening may extend through the housing 1102 from top to bottom. A first hydraulic passage 1112 may extend from the master piston bore 1110 to the central opening. A second hydraulic passage 1122 may extend from the slave piston bore 1120 to the central opening as well as to the control valve 1300 which is positioned behind the slave piston bore in FIG. 8.

A master piston 1130 may be slidably disposed in the master piston bore 1110. The master piston 1130 may have a chamfered lower end to facilitate it being acted upon by hydraulic fluid from below. The master piston 1130 may be biased towards and into contact with the second valve train element 1510 by hydraulic fluid.

A slave piston 1140 may be slidably disposed in the slave piston bore 1120. The slave piston 1140 may include one or more internal passages 1142 which permit hydraulic fluid to flow through the slave piston into and out of the slave piston bore 1120. The slave piston internal passages 1142 may communicate with an annular recess 1144 provided in the side wall of the slave piston 1140. The annular recess 1144 may be sized to selectively register with the second hydraulic passage 1122 such that the travel of the slave piston resulting from hydraulic pressure provided through the slave piston internal passages 1142 is limited by the registration of the annular recess with the second hydraulic passage. When the downward travel of the slave piston 1140 is sufficient that the annular recess 1144 no longer hydraulically communicates with the second hydraulic passage 1122, the hydraulic pressure pushing the slave piston downward may be cut off, thereby limiting the downward travel of the slave piston.

Hydraulic fluid may be supplied to the housing 1102 through a hydraulic fluid supply port 1114, or alternatively from the control valve 1300 connected to the second hydraulic passage 1122. A source of hydraulic fluid (not shown), such as engine sump oil, may be connected to the hydraulic fluid supply port 1114 or control valve 1300. A check valve 1116 may be provided between the source of hydraulic fluid and the master piston bore 1110. The check valve 1116 may prevent hydraulic fluid from flowing out of the housing 1102.

A valve bridge 1200 may be disposed between the lost motion system 1100 and the first and second engine valves 1400 and 1410. The valve bridge 1200 may include a central guide member 1210 which extends upward from the center of the valve bridge and through the central opening provided in the housing 1102. The guide member 1210 may be sized to slide through the central opening while maintaining a hydraulic seal between the guide member and the central opening. A third hydraulic passage 1212 may extend laterally through the guide member 1210, or alternatively, the third hydraulic passage may extend through the housing 1102 around the guide member 1210. The third hydraulic passage 1212 may be placed such that it selectively registers with the first and second hydraulic passages 1112 and 1122 when the valve bridge 1200 is in its upper most position, i.e., when the first and second engine valves 1400 and 1410 are closed.

The valve bridge 1200 may contact the first engine valve 1400 at a first end 1230 and contact the second engine valve 1410 at a second end 1220. The first end 1230 of the valve bridge may incorporate a sliding pin 1240. The sliding pin 1240 may include a shoulder which limits the upward travel of the sliding pin. An upper end of the sliding pin 1240 may extend through the first end 1230 of the valve bridge such that it contacts the bottom of the slave piston 1140.

A control valve 1300 may be mounted in, on or near the housing 1102. The control valve 1300 may communicate hydraulically with the second hydraulic passage 1122. An electronic controller 1310, such as an engine control module (ECM) may be used to actuate the control valve 1300. The control valve 1300 may be in a "closed" position when energized by the controller 1310 that prevents hydraulic fluid from venting through the second hydraulic passage 1122, or alternatively, in an "open" position when energized by the controller such that hydraulic fluid is permitted to vent through the second hydraulic passage. Preferably, the control valve 1300 may be a high-speed trigger valve capable of opening and closing one or more times per engine cycle.

A first valve train element 1500 may contact the upper end of the valve bridge 1200 and a second valve train element 1510 may contact the upper end of the master piston 1130. Optionally, a lash space y may be provided between the first valve train element 1500 and the guide member 1210. It is appreciated that the first and second valve train elements may comprise any one, or a combination of cams, rocker arms, push tubes, or other mechanical, electromechanical, hydraulic, or pneumatic device for imparting a linear actuation motion. The first and second valve train elements 1500 and 1510 may provide cyclical downward motion to the valve bridge 1200 and the master piston 1130, respectively. The first and second valve train elements 1500 and 1510 may collectively produce various engine valve events, such as, but not limited to, main intake, main exhaust, compression release braking, bleeder braking, exhaust gas recirculation, early or late exhaust valve opening and/or closing, early or late intake opening and/or closing, centered lift, etc.

The engine valves 1400 and 1410 may be intake, exhaust, or auxiliary engine valves. The engine valves 1400 and 1410 may be disposed within sleeves (not shown), which in turn are provided in a cylinder head (not shown). The engine valves 1400 and 1410 may be adapted to slide up and down relative to the sleeve and cylinder head to permit gas flow into and out of an engine cylinder.

Figure 12:
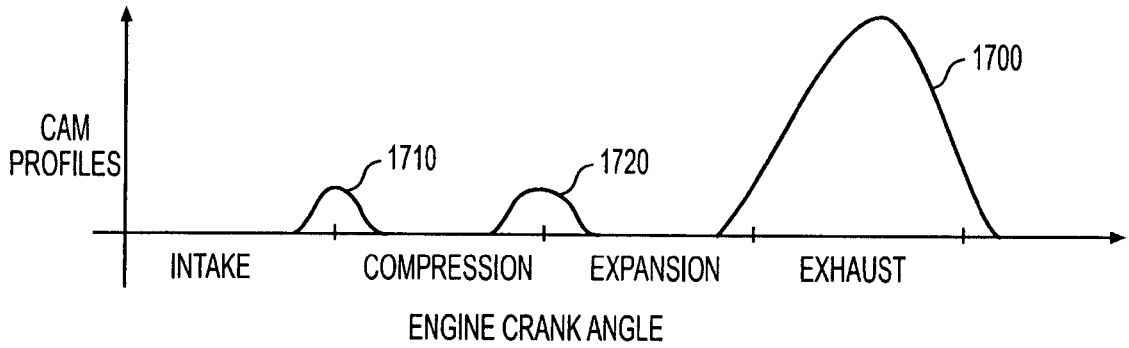
FIG. 12 is a graph illustrating two exemplary cam profiles that may act on the systems shown in FIGS. 8-11 to provide variable valve actuation in accordance with an embodiment of the present invention.

The system 10 shown in FIG. 8 may operate as follows, for example, in a preferred embodiment. With reference to FIG. 12, the first valve train element 1500 may comprise a cam with an main exhaust lobe 1700. The second valve train element 1510, may comprise a cam with an exhaust gas recirculation (EGR) lobe 1710 and an engine braking compression release lobe 1720.

With renewed reference to FIG. 8, during positive power operation, the control valve 1300 may be maintained in an "open" position so that hydraulic fluid that enters the housing 1102 is permitted to vent through the second hydraulic passage 1122. As a result, when the master piston 1130 is pushed downward by the EGR lobe 1710 and the compression release lobe 1720, venting through the second hydraulic passage 1122 prevents hydraulic pressure from building in the slave piston bore 1120 to open the first engine valve 1400 against the force of its valve spring (not shown). The main exhaust lobe present on the first valve train element 1500, however, may push the valve bridge 1200 downward, which causes both the first and second engine valves 1400 and 1410 to open for the main exhaust valve actuations 1820 and 1830 shown in FIGS. 13-14.

Figure 13:
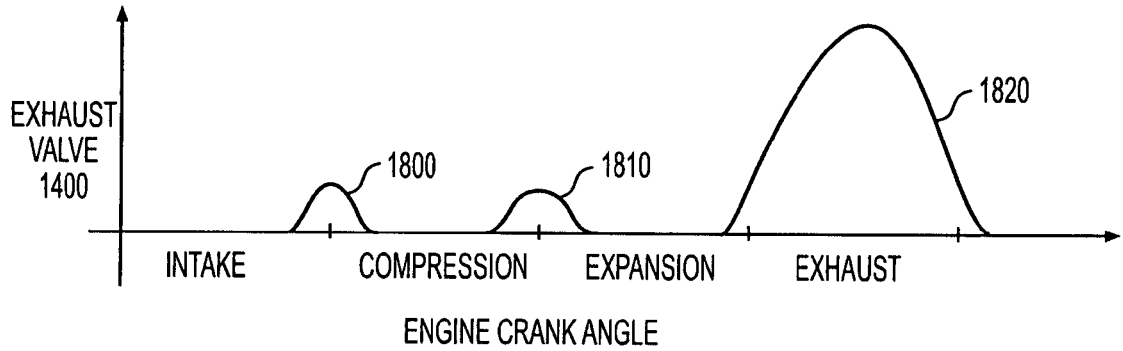
FIG. 13 is a graph illustrating the valve actuation that may be provided to the engine valve 1400 shown in FIGS. 8-11 utilizing the cam profiles illustrated in FIG. 12 in accordance with an embodiment of the present invention.
Figure 14:
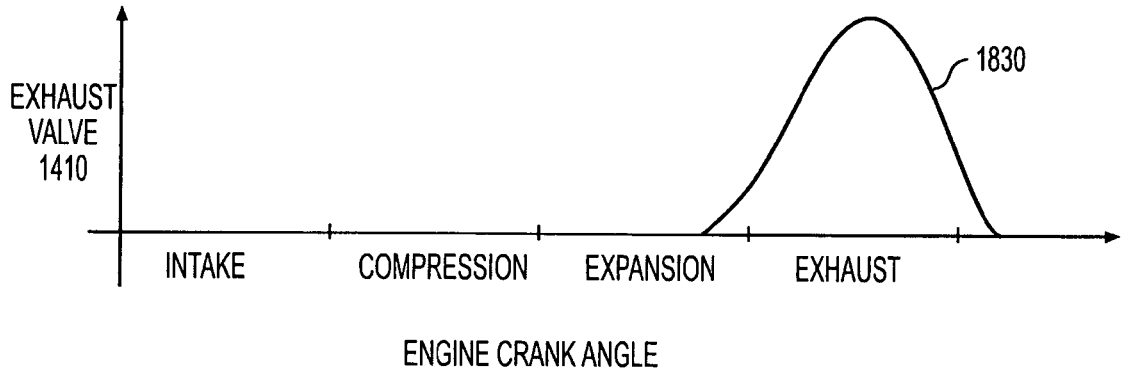
FIG. 14 is a graph illustrating the valve actuation that may be provided to the engine valve 1410 shown in FIGS. 8-11 utilizing the cam profiles illustrated in FIG. 12 in accordance with an embodiment of the present invention.

During engine braking operation, the control valve 1300 (FIG. 8) may be maintained in a "closed" position so that hydraulic fluid that enters the housing 1102 is prevented from venting through the second hydraulic passage 1122. As a result, the master piston 1130 is hydraulically locked in an extended position. As a result, when the master piston 1130 is pushed downward by the EGR lobe 1710 and the compression release lobe 1720, the corresponding hydraulic pressure in the slave piston bore 1120 causes the slave piston 1140 to push the sliding pin 1240 downward and open the first engine valve 1400 for the EGR and compression release valve actuations 1800 and 1810, shown in FIGS. 13 and 14. Additionally, the main exhaust lobe 1700 (FIG. 12) present on the first valve train element 1500 pushes the valve bridge 1200 downward to open the first and second engine valves 1400 and 1410 for the main exhaust valve actuations 1820 and 1830 (FIGS. 13 and 14). Thus, by selectively opening and closing the control valve 1300, the system 10 may selectively provide EGR and compression release valve actuations 1800 and 1810 shown in FIG. 13. Furthermore, the duration of the EGR and compression release valve actuations 1800 and 1810 may be selectively varied if the control valve 1300 is a high-speed trigger valve by selectively opening and/or closing the trigger valve to delay the start or truncate the end of the EGR and compression release valve actuations.

Figure 9:
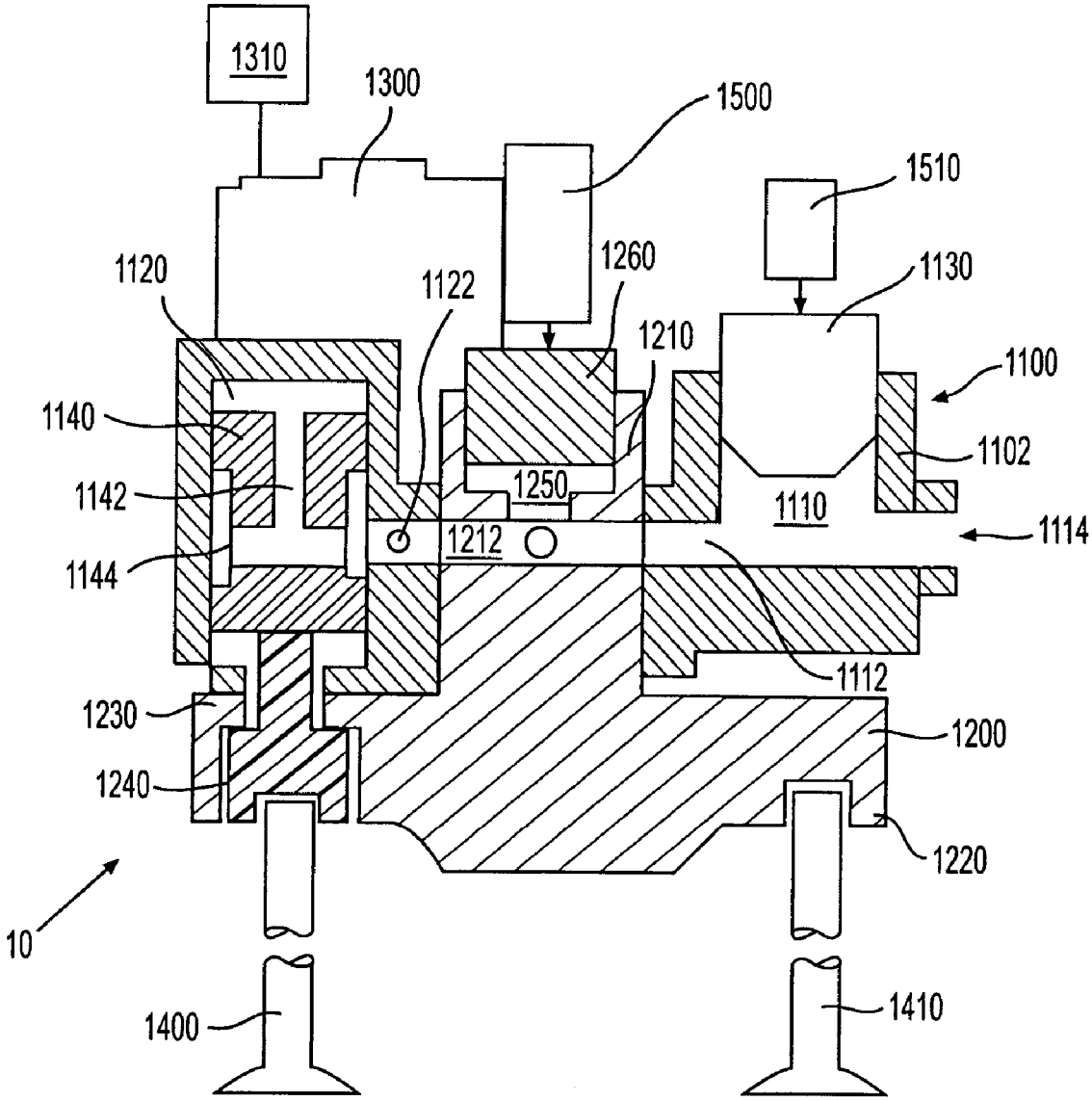
FIG. 9 is a cross-sectional schematic diagram of an engine valve actuation system in accordance with another alternative embodiment of the present invention prior to valve actuation.

A second embodiment of the present invention is illustrated schematically in FIG. 9, in which like reference characters refer to like elements. The second embodiment of the present invention differs from the first in that a second master piston bore 1250 is provided in the upper end of the guide member 1210 and a second master piston 1260 is slidably disposed in the second master piston bore. The second master piston 1260 may permit additional auxiliary valve actuations to be transferred to the slave piston 1140.

Figure 10:
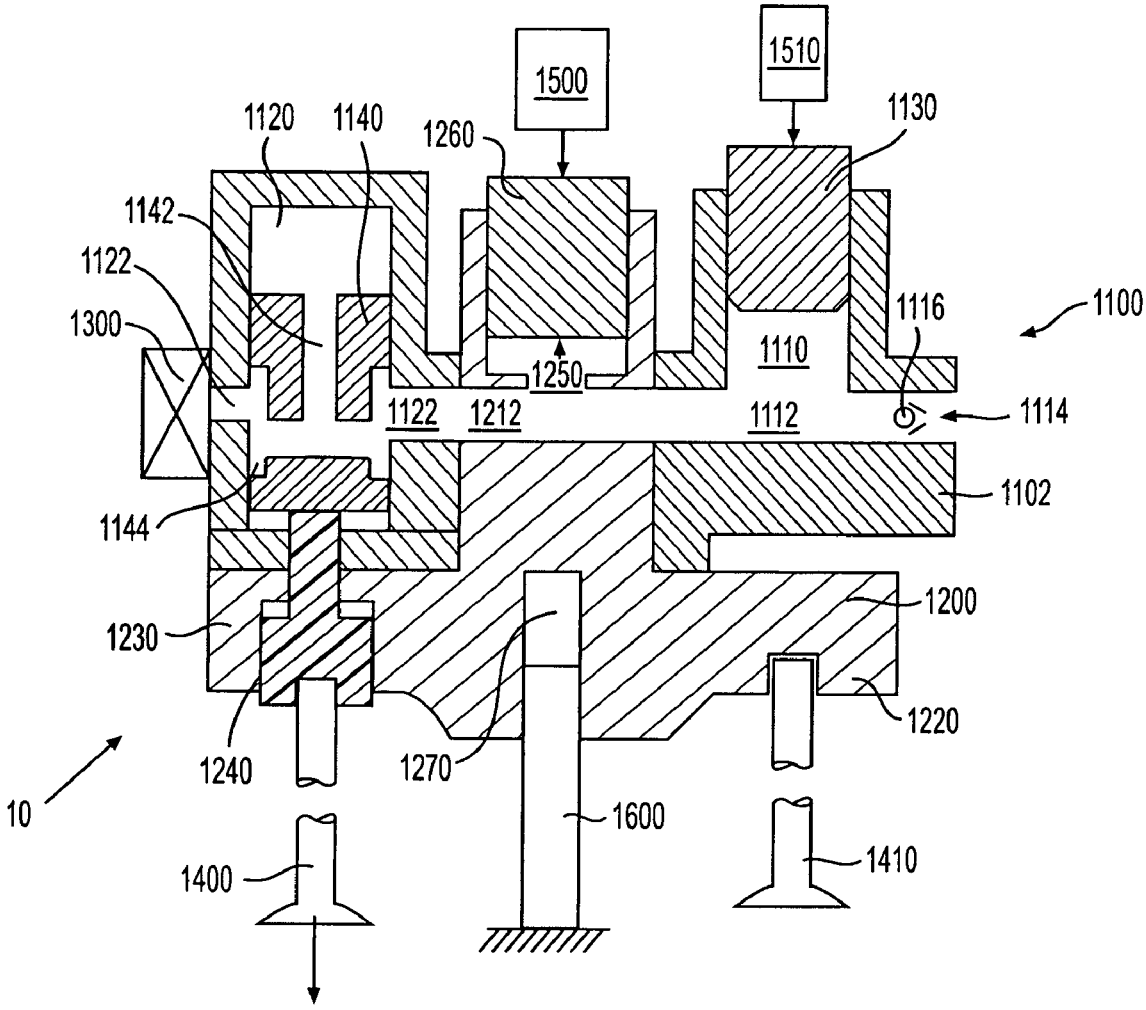
FIG. 10 is a cross-sectional schematic diagram of an engine valve actuation system in accordance with the embodiment of the present invention illustrated in FIG. 9 during actuation of one engine valve.
Figure 11:
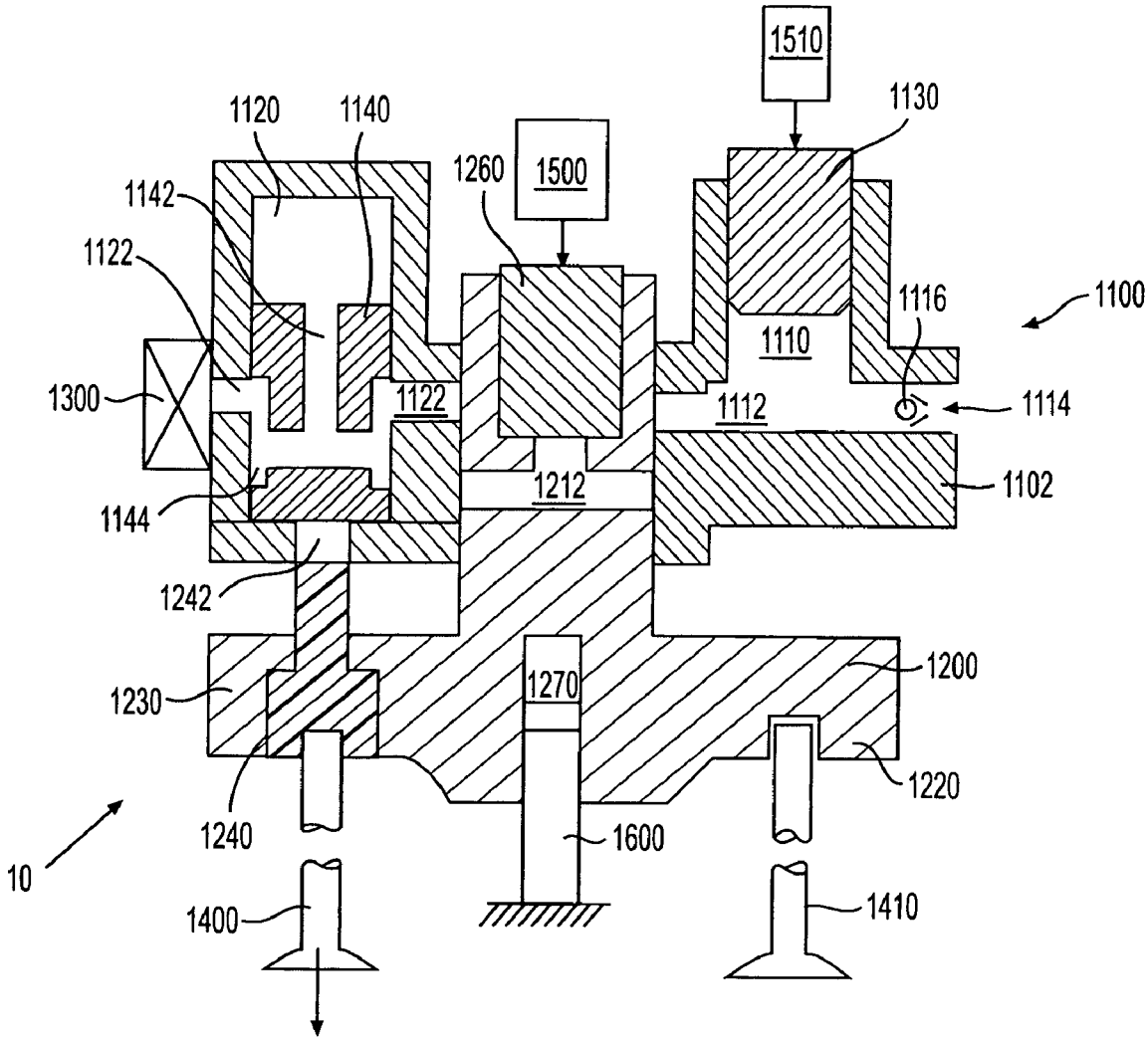
FIG. 11 is a cross-sectional schematic diagram of the engine valve actuation system shown in FIG. 10 during actuation of two engine valves.

A variation of the system shown in FIG. 9 is illustrated in FIGS. 10 and 11, in which like reference characters refer to like elements. With reference to FIG. 10, the second hydraulic passage 1122 is more clearly illustrated to communicate with the control valve 1300. Still further, an optional guide pin bore 1270 may be provided in the lower portion of the valve bridge 1200. The guide pin bore 1270 may be adapted to receive a guide pin 1600 mounted on the engine.

With continued reference to FIG. 10, the second master piston 1260 and the slave piston 1140 are shown during the process of opening the first engine valve 1400 for an auxiliary valve actuation. At this time, the second master piston 1260 is nearly fully pushed into the second master piston bore 1250 and the slave piston 1140 is nearly fully pushed downward in the slave piston bore 1120. The sliding pin 1240 is correspondingly pushed downward such that the first engine valve 1400 is open.

With reference to FIG. 11, in which like reference characters refer to like elements, the system 10 is shown during the process of opening both the first and the second engine valves 1400 and 1410. At this time, the second master piston 1260 and the slave piston 1140 are fully pushed downward in their respective bores, and the valve bridge 1200 has been pushed downward by the first valve train element 1500 to open the first and second engine valves.

Figure 15:
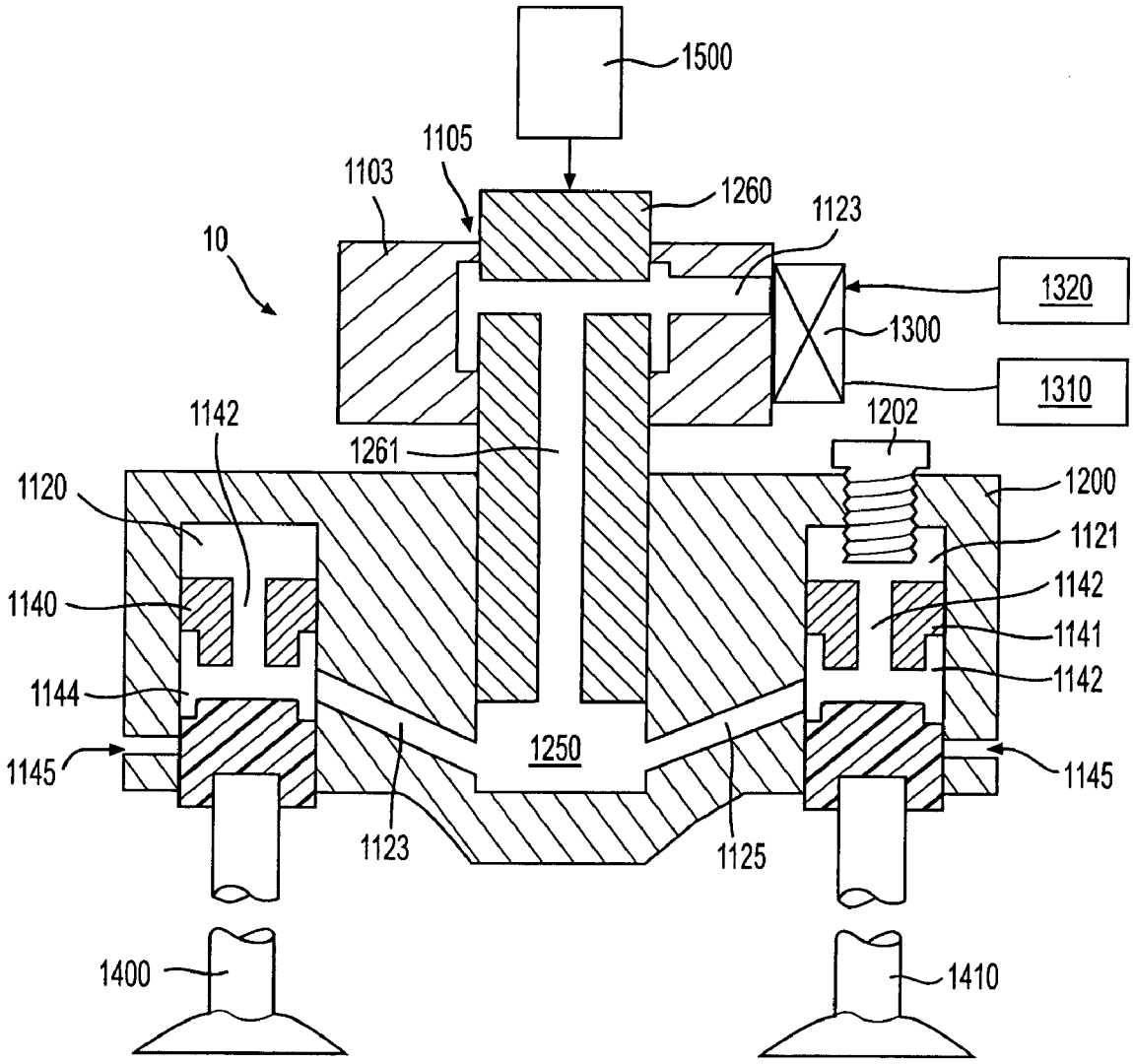
FIG. 15 is a cross-sectional schematic diagram of a valve actuation system in accordance with another alternative embodiment of the present invention.

Another embodiment of the valve actuation system 10 of the present invention is illustrated schematically in FIG. 15, in which like reference characters refer to like elements. With reference to FIG. 15, the system 10 may include a fixed housing 1103, a master piston 1260, a hydraulic fluid control valve 1300, a valve bridge 1200, and first and second slave pistons 1140 and 1141 which contact first and second engine valves 1400 and 1410, respectively. A valve train element 1500 adapted to contact the master piston 1260 may also be provided.

The fixed housing 1103 may include a central opening 1105 and a supply passage extending from the central opening to a control valve 1300. Hydraulic fluid may be provided through the control valve 1300 to the supply passage 1123 from a hydraulic fluid supply 1320, such as a low pressure oil sump. The control valve 1300 may be mounted in, on or near the housing 1103. An electronic controller 1310, such as an engine control module (ECM) may be used to actuate the control valve 1300. The control valve 1300 may be in a "closed" position when energized by the controller 1310 that prevents hydraulic fluid from venting through the supply passage 1123, or alternatively, in an "open" position when energized by the controller such that hydraulic fluid is permitted to vent through the supply passage. Preferably, the control valve 1300 may be a high-speed trigger valve capable of opening and closing one or more times per engine cycle.

The master piston 1260 may be slidably disposed through the central opening 1105. The master piston 1260 may further extend into a master piston bore 1250 provided in the valve bridge 1200. The master piston 1260 may be sized to slide through the central opening 1105 and in the master piston bore 1250 while maintaining a hydraulic seal with each. The master piston 1260 may include one or more internal passages 1261 which permit hydraulic fluid to flow between the supply passage 1123 and the master piston bore 1250. Optionally, the master piston 1260 may be biased upward by a spring (not shown) towards the valve train element 1500.

The master piston bore 1250 may be connected to first and second slave piston bores 1120 and 1121 by hydraulic passages 1123 and 1125, respectively. The first slave piston 1140 may be slidably disposed in the first slave piston bore 1120 and the second slave piston 1141 may be slidably disposed in the second slave piston bore 1121. A leveling screw 1202 may extend into one or both of the slave piston bores. Each of the slave pistons may include one or more internal passages 1142 which permit hydraulic fluid to flow through the slave piston into and out of the slave piston bores. The slave piston internal passages 1142 may communicate with an annular recess 1144 provided in the side wall of each slave piston. The annular recess 1144 may be sized to selectively register with the hydraulic passages 1123 and 1125 such that the travel of the slave pistons resulting from hydraulic pressure provided through the slave piston internal passages 1142 is limited by the registration of the annular recesses with the hydraulic passages 1123 and 1125. When the downward travel of either slave piston is sufficient that the annular recess 1144 no longer hydraulically communicates with the corresponding hydraulic passage 1123 or 1125, the hydraulic pressure pushing the slave piston downward may be cut off, thereby limiting the downward travel of the slave piston. The annular recesses 1144 may also selectively register with clipping passages 1145 that extend from the first and second slave piston bores 1120 and 1121 to the ambient or back to the hydraulic fluid supply.

The system 10 shown in FIG. 15 may operate as follows, for example. With reference to FIG. 12, the valve train element 1500 may comprise a cam with an main exhaust lobe 1700, an exhaust gas recirculation (EGR) lobe 1710, and an engine braking compression release lobe 1720. During positive power operation, the control valve 1300 may be maintained in an "open" position so that hydraulic fluid in the master piston bore 1250 is permitted to vent through the control valve towards the hydraulic supply 1320. As a result, when the master piston 1260 is pushed downward by the EGR lobe 1710 and the compression release lobe 1720, venting from the master piston bore 1250 prevents hydraulic pressure from building in the slave piston bores 1120 and 1121 to open the first and second engine valves 1400 and 1410 against the force of their valve springs (not shown). The main exhaust lobe present on the first valve train element 1500, however, pushes the valve bridge 1200 downward until it mechanically engages the valve bridge 1200, which causes both the first and second engine valves 1400 and 1410 to open for a main exhaust event.

During engine braking operation, the control valve 1300 (FIG. 15) may be closed while the cam including the main exhaust, EGR and compression release lobes is at base circle. As a result, the master piston 1260 may be hydraulically locked into an extended position out of the master piston bore 1250 and into contact with the valve train element 1500 at the time the control valve 1300 is closed. When the control valve 1300 is closed, the hydraulic fluid in the master piston bore 1250 is prevented from venting through the supply passage 1123. As a result, when the master piston 1260 is pushed downward by the EGR lobe 1710 and the compression release lobe 1720, the hydraulic fluid is forced from the master piston bore 1260 towards the first and second slave piston bores 1120 and 1121 causing the first and second slave pistons 1140 and 1141 to open the first and second engine valves 1400 and 1410 for EGR and compression release valve actuations. The main exhaust lobe 1700 (FIG. 12) present on the valve train element 1500 also pushes the master piston 1260 downward to open the first and second engine valves 1400 and 1410 for a main exhaust event. Initially, the main exhaust event may be provided by the first and second slave pistons 1140 and 1141 until the slave piston internal passages 1142 register with the clipping passages 1145. At this time, the hydraulic fluid acting on the first and second slave pistons 1140 and 1141 may vent through the clipping passages until the master piston 1260 mechanically engages the valve bridge 1200. Thereafter the remainder of the main exhaust event, including valve seating, may be carried out by the mechanical contact of the valve train element 1500, the master piston 1260 and the valve bridge 1200. Thus, by selectively opening and closing the control valve 1300, the system 10 may selectively provide EGR and compression release valve actuations 1800 and 1810 shown in FIG. 13. Furthermore, the duration of the EGR and compression release valve actuations 1800 and 1810 may be selectively varied if the control valve 1300 is a high-speed trigger valve by selectively opening and/or closing the trigger valve to delay the start or truncate the end of the EGR and compression release valve actuations.

It will be apparent to those skilled in the art that various modifications and variations can be made in the construction, configuration, and/or operation of the present invention without departing from the scope or spirit of the invention. For example, it is appreciated that either or both of the first and second master and slave pistons may be provided as either a tappet in which a master piston slides into a slave piston, or as a master piston disposed in a fixed master piston bore connected by a hydraulic passage to a slave piston disposed in a fixed slave piston bore. Further, it is appreciated that many other variable valve actuations, other than those shown in FIGS. 12-14, may be provided by the various embodiments of the present invention illustrated in FIGS. 8-11 and 15.

What is claimed is:

1. A system for actuating at least two engine valves of the same type in an internal combustion engine wherein engine valves of the same type are selected from the types consisting of intake valves, exhaust valves and auxiliary valves, comprising:

a first master piston and slave piston lost motion system adapted to actuate a first engine valve in a first engine cylinder;

a second master piston and slave piston lost motion system adapted to actuate a second engine valve in the first engine cylinder;

a control valve in hydraulic communication with the first and second master piston and slave piston lost motion systems;

a hydraulic fluid accumulator in hydraulic communication with the control valve when the control valve is in a first position; and means for clipping motion of the first master piston and slave piston lost motion system when the control valve is in a second position, said means for clipping motion including a clipping passage extending to an ambient.

2. The system of claim 1 wherein the control valve is a trigger valve.

3. The system of claim 2 further comprising a hydraulic fluid supply in hydraulic communication with the trigger valve.

4. The system of claim 3 further comprising a hydraulic fluid supply passage extending between the hydraulic fluid supply and the first master piston and slave piston lost motion system.

5. The system of claim 1 wherein the first master piston and slave piston lost motion system comprises a first master piston slidably disposed within a first slave piston.

6. The system of claim 5 wherein the second master piston and slave piston lost motion system comprises a second master piston slidably disposed within a second slave piston.

7. The system of claim 1 further comprising means for clipping motion of the second master piston and slave piston lost motion system.

8. The system of claim 1 further comprising:

means for controlling the first master piston and slave piston lost motion system to provide compression release engine braking through the first engine valve; and means for controlling the second master piston and slave piston lost motion system to provide early exhaust valve opening through the second engine valve.

9. The system of claim 8 wherein early exhaust valve opening is provided in response to an engine parameter selected from the group consisting of: engine speed and engine load.

10. A system for actuating at least two engine valves of the same type in an internal combustion engine wherein engine valves of the same type are selected from the types consisting of intake valves, exhaust valves and auxiliary valves, comprising:

a housing having a hydraulic fluid supply passage;

a first hydraulic lost motion system disposed in said housing and adapted to contact a first engine valve in an engine cylinder;

a second hydraulic lost motion system disposed in said housing and adapted to contact a second engine valve in the engine cylinder;

a hydraulic control valve disposed in said housing between the (i) hydraulic fluid supply passage and (ii) the first and second hydraulic lost motion systems;

a hydraulic fluid accumulator in hydraulic communication with the control valve when the control valve is in a first position; and means for clipping motion of the first master piston and slave piston lost motion system when the control valve is in a second position, said means for clipping motion including a clipping passage extending to an ambient.

11. The system of claim 10 wherein the control valve is a trigger valve.

12. The system of claim 10 wherein the first hydraulic lost motion system comprises:

a master piston disposed in a fixed master piston bore;

a slave piston disposed in a fixed slave piston bore; and a hydraulic passage connecting the master piston bore to the slave piston bore.

13. The system of claim 10, further comprising:

means for imparting a compression release valve actuation motion to the first hydraulic lost motion system; and means for imparting an early exhaust valve opening valve actuation motion to the second hydraulic lost motion system.

14. The system of claim 13, further comprising:

means for imparting an exhaust gas recirculation valve actuation motion to the first hydraulic lost motion system.

15. A system for actuating at least two engine valves in an internal combustion engine, said system comprising:

a housing having a central opening and hydraulic passages extending to a master piston bore and a slave piston bore, respectively;

a valve bridge adapted to extend between engine valves, said valve bridge having a central guide member extending through the housing central opening and a hydraulic passage extending through the central guide member;

a sliding pin extending through the valve bridge and adapted to contact one of the engine valves;

a master piston disposed in the master piston bore;

a slave piston disposed in the slave piston bore and contacting the sliding pin; and a control valve communicating with the hydraulic passage extending to the slave piston bore.

16. The system of claim 15, wherein the control valve is a high speed trigger valve.

17. The system of claim 16, wherein (i) the hydraulic passages extending to the master piston bore and the slave piston bore and (ii) the hydraulic passage extending through the central guide member are adapted to selectively register with one another to provide selective hydraulic fluid flow between them.

18. The system of claim 17 further comprising one or more hydraulic fluid passages extending through the slave piston.

19. The system of claim 18, wherein the one or more hydraulic fluid passages extending through the slave piston communicate with an annular recess provided in a side wall of the slave piston, and wherein the annular recess is selectively sized to limit the travel of the slave piston in the slave piston bore.

20. The system of claim 15 further comprising a central bore in the lower portion of the valve bridge which is adapted to receive a guide pin.

21. The system of claim 15, wherein (i) the hydraulic passages extending to the master piston bore and the slave piston bore and (ii) the hydraulic passage extending through the central guide member are adapted to selectively register with one another to provide selective hydraulic fluid flow between them.

22. The system of claim 15 further comprising one or more hydraulic fluid passages extending through the slave piston.

23. The system of claim 22, wherein the one or more hydraulic fluid passages extending through the slave piston communicate with a annular recess provided in a side wall of the slave piston, and wherein the annular recess is selectively sized to limit the travel of the slave piston in the slave piston bore.

24. A system for actuating at least two engine valves in an internal combustion engine, said system comprising:

a housing having a central opening and hydraulic passages extending from said central opening to a first master piston bore and a slave piston bore, respectively;

a valve bridge adapted to extend between engine valves, said valve bridge having a central guide member extending through the housing central opening, a second master piston bore provided an upper end of the central guide member, and a hydraulic passage extending through the central guide member and communicating with the second master piston bore;

a sliding pin extending through the valve bridge and adapted to contact one of the engine valves;

a first master piston disposed in the first master piston bore;

a second master piston disposed in the second master piston bore;

a slave piston disposed in the slave piston bore and contacting the sliding pin; and a control valve communicating with the hydraulic passage extending to the slave piston bore.

25. The system of claim 24, wherein the control valve is a high speed trigger valve.

26. The system of claim 25, wherein (i) the hydraulic passages extending to the master piston bore and the slave piston bore and (ii) the hydraulic passage extending through the central guide member are adapted to selectively register with one another to provide selective hydraulic fluid flow between them.

27. The system of claim 26 further comprising one or more hydraulic fluid passages extending through the slave piston.

28. The system of claim 27, wherein the one or more hydraulic fluid passages extending through the slave piston communicate with an annular recess provided in a side wall of the slave piston, and wherein the annular recess is selectively sized to limit the travel of the slave piston in the slave piston bore.

29. The system of claim 24 further comprising a central bore in the lower portion of the valve bridge which is adapted to receive a guide pin.

30. The system of claim 24, wherein (i) the hydraulic passages extending to the master piston bore and the slave piston bore and (ii) the hydraulic passage extending through the central guide member are adapted to selectively register with one another to provide selective hydraulic fluid flow between them.

31. The system of claim 24 further comprising one or more hydraulic fluid passages extending through the slave piston.

32. The system of claim 31, wherein the one or more hydraulic fluid passages extending through the slave piston communicate with a annular recess provided in a side wall of the slave piston, and wherein the annular recess is selectively sized to limit the travel of the slave piston in the slave piston bore.

33. A method of actuating two engine valves of the same type associated with a common engine cylinder using first and second lost motion systems and a common control valve wherein engine valves of the same type are selected from the types consisting of intake valves, exhaust valves and auxiliary valves, comprising the steps of:

providing hydraulic fluid to the first lost motion system during a first engine operating mode;

selectively maintaining hydraulic fluid in the first lost motion system under the control of the common control valve during the first engine operating mode;

providing hydraulic fluid to the second lost motion system during a second engine operating mode; and selectively maintaining hydraulic fluid in the second lost motion system under the control of the common control valve during the second engine operating mode.

34. The method of claim 33 wherein hydraulic fluid is selectively released from the first lost motion system under the control of the common control valve during the second engine operating mode.

35. The method of claim 33 wherein the first engine operating mode is an engine braking mode.

36. The method of claim 35 wherein the second engine operating mode is an early exhaust valve opening mode.

* * * * *